US007025105B2

(12) United States Patent
Lancina

(10) Patent No.: US 7,025,105 B2
(45) Date of Patent: Apr. 11, 2006

(54) SLIDING SCREEN EDGE SEALS

(75) Inventor: Francisco Javier Lancina, Worcestershire (GB)

(73) Assignee: Reddiplex Group plc., (GB)

( * ) Notice: Subject to any disclaimer, the term of this patent is extended or adjusted under 35 U.S.C. 154(b) by 0 days.

(21) Appl. No.: 10/288,994

(22) Filed: Nov. 6, 2002

(65) Prior Publication Data

US 2003/0106648 A1 Jun. 12, 2003

(30) Foreign Application Priority Data

Dec. 6, 2001 (GB) ..... 0129189

(51) Int. Cl.
*E06B 7/16* (2006.01)

(52) U.S. Cl. ..... 160/41

(58) Field of Classification Search ..... 160/41, 160/201, 272, 290.1, 273.1, 133, 232, 270, 160/271, 11, 42, 43, 290; 49/496.1, 442
See application file for complete search history.

(56) References Cited

U.S. PATENT DOCUMENTS 2,354,832 A * 8/1944 Ristine ..... 160/11
2,523,839 A * 9/1950 McKinney ..... 49/436
3,562,886 A * 2/1971 Olson et al. ..... 29/897.312
3,946,524 A * 3/1976 Budich ..... 49/442
4,333,511 A * 6/1982 Johnston ..... 160/267.1
4,467,853 A * 8/1984 Downey, Jr. ..... 160/133
4,468,889 A * 9/1984 Jolly ..... 49/453
5,307,861 A * 5/1994 Townsend ..... 164/428
5,839,493 A * 11/1998 Quasius ..... 160/133
6,082,432 A * 7/2000 Kissinger ..... 160/290.1
6,123,135 A * 9/2000 Mathews ..... 160/26
6,131,235 A * 10/2000 Snyder ..... 15/308
6,490,832 B1 * 12/2002 Fischbach et al. ..... 52/207
6,629,555 B1 * 10/2003 DeBlock et al. ..... 160/31
6,823,924 B1 * 11/2004 Martin ..... 160/105

FOREIGN PATENT DOCUMENTS

EP 408871 A * 1/1991
GB 2154642 A * 9/1985
IT TV94A000139 * 12/1994 ..... 160/272 X

* cited by examiner

*Primary Examiner*—David Purol
(74) *Attorney, Agent, or Firm*—Renner, Kenner, Greive, Bobak, Taylor & Weber

(57) ABSTRACT

A sliding screen edge sealing device for an edge of a sliding screen of flexible material comprises a pair of sealing brushes one on each side of the screen. Each sealing brush comprises brush filaments projecting from a base that is non-pivotally mounted, the arrangement being such that the brush filaments are inclined in the same direction relative to the screen. The brush filaments may be inclined to the base.

43 Claims, 1 Drawing Sheet

SLIDING SCREEN EDGE SEALS

This invention relates to sealing means for the edges of sliding screens of flexible material, such as fly screens, sun screens and the like.

Fly screens are flexible mesh laminar members, designed to cover windows and doors in a building to prevent ingress of insects while allowing the window or door to be open. Typically a fly screen is mounted to slide downwards to cover the opening, like a roller blind, or across the opening, like a patio door. In either case, the free edge has a sliding rail by which it is moved, and opposing edges of the screen are guided to slide in respective guide channels formed in side members, which are typically aluminium extrusions. The sliding edges of the screen need sealing means to prevent insects entering between the edge and the guide channel.

One known sealing means comprises a pair of elongate sealing brushes, one on each side of the screen edge. Each has brush filaments projecting at right angles from a base received in a brush channel in the side member. The brush filaments are also at right angles to the screen. This arrangement works well to exclude insects, except when the screen is blown by the wind, when the edge tends to come out of its guide channel. The brush filaments are unable to hold the edge against movement out of the plane in which it slides.

In another known sealing means, which overcomes this problem, one of the sealing brushes is replaced by a pile strip, while the base of the other brush can pivot in its brush channel. The pivoting brush moves away from the screen to allow the edge of the screen to slide, but moves towards it when the wind blows to hold it securely. Although this arrangement holds the edge in the wind, it has the disadvantage that the pivoting brush requires a specially-shaped brush channel, so that it cannot be used in existing brush channels, but requires replacement of the side members.

A further known sealing means is disclosed in DE-A-196 39 478 (Neher Systeme GmbH & Co.) in which the sealing brushes are inclined to the screen. The brushes are mounted in specially angled brush channels and the brush filaments extend therefrom whereby their free ends are in contact. The arrangement being such that the screen slides between the brushes. This has the disadvantage that the screen is abraded as it slides and can snag on the brushes due to their close contact.

According to a first aspect of the invention, edge sealing means for an edge of a sliding screen of flexible material comprises a pair of sealing brushes, one on each side of the screen, each sealing brush comprising brush filaments projecting from a base which is non-pivotally mounted, the arrangement being such that the brush filaments are inclined in the same direction relative to the screen.

Having both brush filaments inclined in the same direction to the screen, but non-pivoting bases, is effective to exclude insects, and allows the edge to slide, but also holds the edge effectively when the wind blows, against movement out of the sliding plane. Having the brush filaments arranged so that there is a gap allows the screen to slide smoothly and ensures that the brush filaments do not abrade the screen as it slides.

The sealing brushes may be mounted in a brush channel and be of the known type, with the filaments perpendicular to the base. Then the brush channels need to be inclined. However, the brush channels will then take up more room in the side members. Preferably therefore the brush filaments are angled relative to the base. The existing brush channels can then be used. The sealing means can therefore be used in existing installations, without changing the side members.

Where the brush filaments are angled relative to the base, the base preferably includes an extension adapted in use to project out of the brush channel. A sliding rail mounted on a free edge of the screen will then come into contact with the extension rather than the brush channel as it moves, and if the base is of plastics, this will reduce wear on the edge of the sliding rail.

The density of the brush filaments at their free ends is dependent upon the gauge of the individual filaments. However, it has been found preferable to use a brush filament density of less that 150 filaments per centimeter to ensure there is sufficient spacing to permit effective meshing of the brush and screen in order to hold the screen against movement.

According to a second aspect of the invention, edge sealing means for an edge of a sliding screen of flexible material comprises a pair of sealing brushes, one on each side of the screen, each sealing brush comprises brush filaments projecting from a base which is non-pivotally mounted, the arrangement being such that a brush filaments are inclined relative to the base and in the same direction relative to the screen.

The sealing brushes may be mounted in a brush channel. When sealing brushes of known type, with the filaments perpendicular to the base, are used the brush channels need to be inclined. The brush channels will then take up more room. Brush filaments that are inclined to the base can use existing brush channels and therefore side members do not need to be change.

The brush filaments may be arranged so that a gap is provided between them for the screen. This ensures that the brush filaments do not abrade the screen as it slides.

Where the brush filaments are angled relative to the base, the base preferably includes an extension adapted in use to project out of the brush channel. A sliding rail mounted on a free edge of the screen will then come into contact with the extension rather than the brush channel as it moves, and if the base is of plastics, this will reduce wear on the edge of the sliding rail.

The density of the brush filaments at their free ends is dependent upon the gauge of the individual filaments. However, it has been found preferable to use a brush filament density of less that 150 filaments per centimeter to ensure there is sufficient spacing to permit effective meshing of the brush and screen in order to hold the screen against movement.

According to a third aspect of the invention, edge sealing means for an edge of a sliding screen of flexible material comprises a pair of sealing brushes, one on each side of the screen, each sealing brush comprising brush filaments projecting from a base which is non-pivotally mounted, the arrangement being such that the brush filaments are inclined in the same direction relative to the screen and each sealing brush is mounted in a brush channel and each base includes an extension adapted in use to project out of the brush channel to come into contact with a slide rail of the sliding screen.

Having the sliding rail coming into contact with the extension rather than the brush channel as it moves will reduce wear on the edge of the sliding rail, especially if the base is of plastics.

The brush filaments may be arranged so that a gap is provided between them for the screen. This ensures that the brush filaments do not abrade the screen as it slides.

The sealing brushes may be of the known type, with the filaments perpendicular to the base. Then the brush channels need to be inclined. However, the brush channels will then take up more room in the side members. Preferably therefore the brush filaments are angled relative to the base. The existing brush channels can then be used. The sealing means can therefore be used in existing installations, without changing the side members.

The density of the brush filaments at their free ends is dependent upon the gauge of the individual filaments. However, it has been found preferable to use a brush filament density of less that 150 filaments per centimeter to ensure there is sufficient spacing to permit effective meshing of the brush and screen in order to hold the screen against movement.

According to a fourth aspect of the invention, edge sealing means for an edge of a sealing screen of flexible material comprises a pair of sealing brushes, one on each side of the screen, each sealing brush comprising brush filaments projecting from a base which is non-pivotally mounted, the arrangement being such that the brush filaments are inclined in the same direction relative to the screen and at their free ends, they form a region of brush filament density of less that 150 filaments per centimeter.

It has been found that having a density of less than 150 filaments per centimeter permits sufficient meshing of brush and screen for holding the screen against movement.

The brush filaments may be arranged so that a gap is provided between them for the screen. This ensures that the brush filaments do not abrade the screen as it slides.

The sealing brushes may be mounted in a brush channel and be of the known type, with the filaments perpendicular to the base. Then the brush channels need to be inclined. However, the brush channels will then take up more room in the side members. Preferably therefore the brush filaments are angled relative to the base. The existing brush channels can then be used. The sealing means can therefore be used in existing installations, without changing the side members.

Where the brush filaments are angled relative to the base, the base preferably includes an extension adapted in use to project out of the brush channel. A sliding rail mounted on a free edge of the screen will then come into contact with the extension rather than the brush channel as it moves, and if the base is of plastics, this will reduce wear on the edge of the sliding rail.

The features described hereinafter may be applicable to all of the four aspects of the invention stated above.

Preferably, one of the brush filaments is longer than the other, so that the lines of contact between the screen and the brushes are offset. The line of contact between the screen and the longer brush will be displaced outwardly of the screen. This assists in the sliding of the screen. On movement of the screen out of its sliding plane, the screen is caught by at least one of the brushes, and the offset lines of contact ensure that it is released easily.

Preferably, each of the brush filaments is inclined in the range of 30° to 60° to the screen. However, the angle of inclination could be about 45°. Further, the brush filaments need not be inclined at the same angle.

The sealing brushes are preferably mounted in brush channels in side members for the screen. Each sliding edge of the screen is guided in a guide channel in the side member.

Conveniently, the sealing brushes are formed by co-extruding monofilament brush filaments with a plastics base. The gauge of the monofilament is preferably between 0.1 mm and 0.25 mm. A fifth aspect of the invention relates to the sealing brushes themselves.

According to a fifth aspect of the invention, a sealing brush for sealing between a sliding member and a fixed member comprises an elongate base from which brush filaments project at an angle other that 90°.

The sealing brush according to the fifth aspect of the invention is particularly useful for sealing edges of sliding screens.

The base of the sealing brush is preferably of plastics material. The base may include an extension projecting substantially at 90°, and a recess in which the brush filaments are received.

The brush filaments are preferably monofilaments of plastics material such as polypropylene or nylon. The gauge of the monofilament is preferably between 0.1 mm and 0.25 mm.

The sealing brush is conveniently made by co-extrusion of the brush filaments and the base.

Preferably, the density of the brush filaments at their free ends is greater than 10 filaments per centimeter. The brush filament density is dependent on the gauge of the monofilaments, however, with a filament gauge of between 0.1 mm and 0.25 mm, a brush filament density of between 10 and 150 filaments per centimeter is achievable.

Most preferably, the density of the brush filaments at their free ends is about 100 or 120 filaments per centimeter. However, the brush filament density could be about 20, 30, 40, 50, 60, 70, 80, 90 or 110 filaments per centimeter.

The bases of the brush filaments may be grouped into spaced tufts.

An embodiment of the invention is illustrated, by way of example only, in the accompanying drawings, in which.

Figure 1:
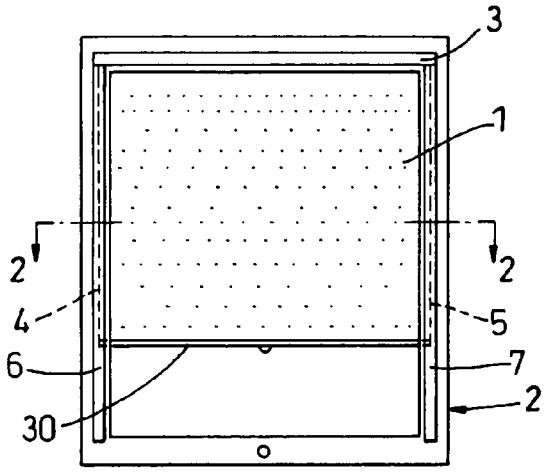
FIG. 1 shows schematically a window with a sliding screen.

FIG. 1 shows a sliding screen 1, in this case a mesh fly screen, adapted to cover a window 2 in a building. The screen 1 operates like a roller blind, being housed in a cassette 3 at the top of the window frame, and being pulled down by a sliding rail 30 and fastened at the bottom of the window 2 as required, and then retracted when not required. The side edges 4, 5 slide in respective side members 6, 7, which are of known type. The side members are fixed to the window frame, and have sealing means 8 preventing ingress of insects round the edges 4, 5.

Figure 2:
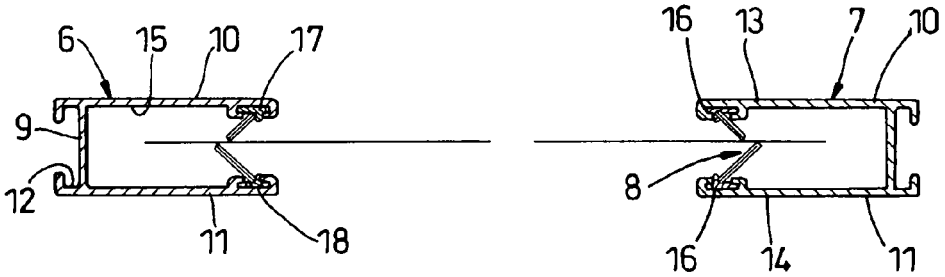
FIG. 2 shows a section along the line 2—2 of FIG. 1.

The side members 6, 7 are shown in more detail in FIG. 2. Each side member 6, 7 is an aluminium extrusion of substantially U-shape, with a base 9 transverse to two opposed elongate members 10, 11. The outer ends (relative to the window 2) of the members 10, 11 are inturned to form with the base 9 a small open-faced channel 12. The inner ends 13, 14 are longer, and define between them a guide channel 15 in which an edge 4, 5 of the screen is received and guided for sliding. Each inner end 13, 14 of the members 10, 11 is formed with an open-sided brush channel 16 to receive part of the sealing means 8. Each brush channel 16 is formed at the inner end of the guide channel 15, so that the open sides of the brush channels 16 face one another.

Figure 3:
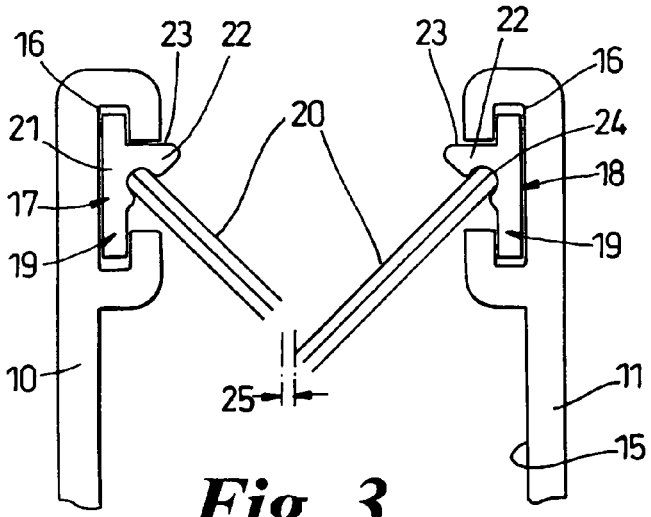
FIG. 3 is an enlarged view of part of FIG. 2, showing the sealing means for the edge of the screen.
Figure 4:
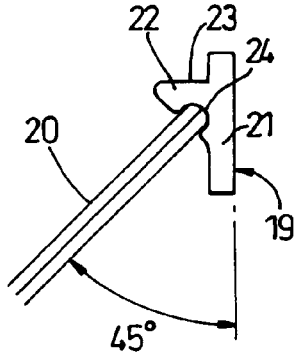
FIG. 4 is an end view of a sealing brush shown in FIGS. 2 and 3.

The sealing means 8 received in the brush channels 16 are shown in more detail in FIGS. 3 and 4, and comprise a pair of sealing brushes 17, 18. Each is formed by a plastics base 19 adapted to be received in the channel 16, and brush filaments 20 projecting at an angle of about 45° to the base 19. Each base 19 has a flat portion 21 able to slide in the channel 16, and an extension 22 projecting substantially at right angles to the flat portion 21. The extension 22 projects beyond the channel 16, and on one side has a flat surface 23 for engagement with the edge of the channel 16 and on the other side a recess 24 in which the brush filaments 20 are received. The brush filaments 20 comprise a polypropylene monofilament having a gauge of 0.18 mm, and the base 19 and filaments 20 are coextruded.

It will be seen from FIG. 3 that the sealing brushes 17, 18 are both inclined in the same directions towards the screen 1, so that the angle between them is approximately 90°. Further, the brush filaments 20 on the brush 18 are longer than those on the brush 17, and a gap 25 is defined between the free ends of brush filaments 20 of the brushes 17, 18, to allow for passage of the screen 1.

In use, with the sealing brushes 17, 18 received in the channels 16 of the side members (the flat portion 21 of the base 19 simply slides into the brush channel 16) the edges 4, 5 of the screen 1 are received in the respective guide channels 15, in the gap 25 between the sealing brushes 17, 18. The brush filaments 20 deflect as necessary to allow the edges 4, 5 to slide, and with the screen 1 pulled down act to prevent insects entering round the edges 4, 5 of the screen 1.

When the wind blows, the screen 1 will move out of the plane in which it slides, as it tends to balloon inwardly or outwardly. On movement of the edges 4, 5 out of the sliding plane, the brush filaments 20 act to catch the edges 4, 5 to prevent them coming out of the guide channel 15. When the edges return to the sliding plane, they are released by the filaments 20, to allow sliding movement of the screen 1.

The embodiment shown in the drawings has a number of advantages. Firstly, it works well to retain the screen edges when the wind blows, while making use of the standard side members 6, 7. It also allows for easy sliding of the screen 1. It will also be appreciated that the lines of contact of the brush filaments 20 on the two sealing brushes 17, 18 with the screen 1 are offset, with that for the shorter brush 17 being inward of that for the brush 18. This has the advantage that the wear occurs at a different place on each side of the screen 1. A further wear-reducing feature is the extension 22; as the sliding rail 30 slides it will tend to come into contact with the plastics extension 22 rather than the aluminium channel 16.

It will be appreciated that, although the brush filaments 20 are both shown at 45° to the base 19, the angle could be changed. Thus, the two brush filaments could be at different angles, or they could be at the same angle, which could be between 30° and 60°. The relative lengths of the two brush filaments would be chosen accordingly. The gauge of the monofilament may also be chosen as required, preferably from the range 0.1 mm to 0.25 mm. The gap 25 may also be varied if required.

Figure 5:
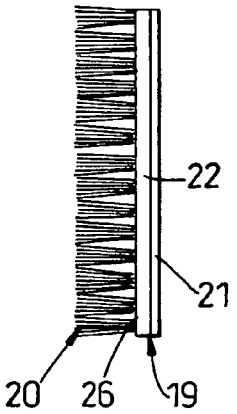
FIG. 5 is a side view of a sealing brush shown in FIGS. 2, 3 and 4.

FIG. 5 shows a side view of a sealing brush comprising the base 19 and brush filaments 20. The brush filaments 20 form a region of substantially uniform density at their free ends while at their bases they are grouped in spaced tufts 26. The brush filaments 20 may be substantially uniform at their bases and free ends if required.

The invention claimed is:

1. A sliding screen of flexible material and edge sealing means for an edge of said sliding screen comprises a pair of sealing brushes, one on each side of said screen, each said sealing brush comprising brush filaments projecting from a base, said base being non-pivotally mounted, said brush filaments being inclined in the same direction relative to said screen, wherein said brush filaments are arranged so that a gap is provided between them for said screen, and one of said brush filaments is longer than the other, so that the lines of contact between said screen and said brushes are offset.

2. A sliding screen of flexible material and edge sealing means as claimed in claim 1, wherein the angle of inclination to said screen of each of said brush filaments is between 30° and 60°.

3. A sliding screen of flexible material and edge sealing means as claimed in claim 1, wherein said brush filaments are inclined at approximately 45° to said screen.

4. A sliding screen of flexible material and edge sealing means as claimed in claim 1, wherein said brush filaments are angled to said base to provide the inclination to said screen.

5. A sliding screen of flexible material and edge sealing means as claimed in claim 1, wherein each said sealing brush is mounted in a brush channel and said screen has a sliding rail and each said base includes an extension adapted in use to project out of said brush channel to come into contact with said sliding rail.

6. A sliding screen of flexible material and edge sealing means as claimed in claim 1, wherein said brush filaments are arranged being such that at their free ends they form a region of brush filament density of less than 150 filaments per centimeter.

7. A sliding screen of flexible material and edge sealing means as claimed in claim 1, wherein the density of said brush filaments at their free ends is greater than 10 filaments per centimeter.

8. A sliding screen of flexible material and edge sealing means as claimed in claim 1, wherein the density of said brush filaments at their free ends is substantially 100 filaments per centimeter.

9. A sliding screen of flexible material and edge sealing means as claimed in claim 1, wherein the density of said brush filaments at their free ends is substantially 120 filaments per centimeter.

10. A sliding screen of flexible material and edge sealing means as claimed in claim 1, wherein said brush filaments are grouped to project from their respective base in a plurality of spaced tufts.

11. A sliding screen of flexible material and edge sealing means for an edge of said sliding screen comprises a pair of sealing brushes, each said sealing brush comprising brush filaments projecting from a base, each said base being non-pivotally mounted within a channel having an open side, with one channel on each side of said screen such that said open sides directly face one another, wherein said brush filaments are inclined relative to said base and to said open sides and in the same direction relative to said screen.

12. A sliding screen of flexible material and edge sealing means as claimed in claim 11, wherein the angle of inclination to said base of each of said brush filaments is between 30° and 60°.

13. A sliding screen of flexible material and edge sealing means as claimed in claim 11, wherein said brush filaments are inclined at approximately 45° to said base.

14. A sliding screen of flexible material and edge sealing means as claimed in claim 11, wherein one of said brush filaments is longer than the other, so that the lines of contact between said screen and said brushes are offset.

15. A sliding screen of flexible material and edge sealing means as claimed in claim 11, wherein each said sealing brush is mounted in a brush channel and said screen has a sliding rail and each said base includes an extension adapted in use to project out of said brush channel to come into contact with said sliding rail.

16. A sliding screen of flexible material and edge sealing means as claimed in claim 11, wherein said brushes are arranged so that a gap is provided between them for said screen.

17. A sliding screen of flexible material and edge sealing means as claimed in claim 11, wherein said brush filaments are arranged being such that at their free ends they form a region of brush filament density of less than 150 filaments per centimeter.

18. A sliding screen of flexible material and edge sealing means as claimed in claim 11, wherein the density of said brush filaments at their free ends is greater than 10 filaments per centimeter.

19. A sliding screen of flexible material and edge sealing means as claimed in claim 11, wherein the density of said brush filaments at their free ends is substantially 100 filaments per centimeter.

20. A sliding screen of flexible material and edge sealing means as claimed in claim 11, wherein the density of said brush filaments at their free ends is substantially 120 filaments per centimeter.

21. A sliding screen of flexible material and edge sealing means as claimed claim 11, wherein said bases of said brush filaments are grouped in spaced tufts.

22. A sliding screen of flexible material and edge sealing means for an edge of said sliding screen comprises a pair of sealing brushes, one on each side of said screen, each said sealing brush comprising brush filaments projecting from a base, said base being non-pivotally mounted, said brush filaments being inclined in the same direction relative to said screen, each said sealing brush being mounted in a brush channel and said screen having a sliding rail, wherein said base includes an extension adapted in use to project out of said brush channel to come into contact with said sliding rail.

23. A sliding screen of flexible material and edge sealing means as claimed in claim 22, wherein one of said brush filaments is longer than the other, so that the lines of contact between said screen and said brushes are offset.

24. A sliding screen of flexible material and edge sealing means as claimed in claim 22, wherein the angle of inclination to said screen of each of said brush filaments is between 30° and 60°.

25. A sliding screen of flexible material and edge sealing means as claimed in claim 22, wherein said brush filaments are inclined at approximately 45° to said screen.

26. A sliding screen of flexible material and edge sealing means as claimed in claim 22, wherein said brush filaments are angled to said base to provide the inclination to said screen.

27. A sliding screen of flexible material and edge sealing means as claimed in claim 22, wherein said brushes are arranged so that a gap is provided between them for said screen.

28. A sliding screen of flexible material and edge sealing means as claimed in claim 22, wherein said brush filaments are arranged being such that at their free ends they form a region of brush filament density of less than 150 filaments per centimeter.

29. A sliding screen of flexible material and edge sealing means as claimed in claim 22, wherein the density of said brush filaments at their free ends is greater than 10 filaments per centimeter.

30. A sliding screen of flexible material and edge sealing means as claimed in claim 22, wherein the density of said brush filaments at their free ends is substantially 100 filaments per centimeter.

31. A sliding screen of flexible material and edge sealing means as claimed in claim 22, wherein the density of said brush filaments at their free ends is substantially 120 filaments per centimeter.

32. A sliding screen of flexible material and edge sealing means as claimed in claim 22, wherein said bases of said brush filaments are grouped in spaced tufts.

33. A sliding screen of flexible material and edge sealing means for an edge of said sliding screen comprises a pair of sealing brushes, one on each side of said screen, each said sealing brush comprising brush filaments projecting from a base, each said base being non-pivotally mounted within a brush channel, each said brush channel having an open side, one said brush channel on each side of said screen such that said open sides thereof face one another, said brush filaments being inclined in the same direction relative to said screen, wherein said brush filaments form a region of brush filament density of less than 150 filaments per centimeter at their free ends.

34. A sliding screen of flexible material and edge sealing means as claimed in claim 33, wherein the density of said brush filaments at their free ends is greater than 10 filaments per centimeter.

35. A sliding screen of flexible material and edge sealing means as claimed in claim 33, wherein the density of said brush filaments at their free ends is substantially 100 filaments per centimeter.

36. A sliding screen of flexible material and edge sealing means as claimed in claim 33, wherein the density of said brush filaments at their free ends is substantially 120 filaments per centimeter.

37. A sliding screen of flexible material and edge sealing means as claimed in claim 33, wherein said bases of said brush filaments are grouped in spaced tufts.

38. A sliding screen of flexible material and edge sealing means as claimed in claim 33, wherein one of said brush filaments is longer than the other, so that the lines of contact between said screen and said brushes are offset.

39. A sliding screen of flexible material and edge sealing means as claimed in claim 33, wherein the angle of inclination to said screen of each of said brush filaments is between 30° and 60°.

40. A sliding screen of flexible material and edge sealing means as claimed in claim 33, wherein said brush filaments are inclined at approximately 45° to said screen.

41. A sliding screen of flexible material and edge sealing means as claimed in claim 33, wherein said brush filaments are angled to said base to provide the inclination to said screen.

42. A sliding screen of flexible material and edge sealing means as claimed in claim 33, wherein said brushes are arranged so that a gap is provided between them for said screen.

43. A sliding screen of flexible material and edge sealing means as claimed in claim 33, wherein each said sealing brush is mounted in a brush channel and said screen has a sliding rail and each said base includes an extension adapted in use to project out of said brush channel to come into contact with said sliding rail.

* * * * *